US005398835A

United States Patent [19]

Blinstrub

[11] Patent Number: 5,398,835

[45] Date of Patent: Mar. 21, 1995

[54] COLLAPSIBLE MATERIAL HANDLING CONTAINER HAVING IMPROVED CORNER INTERLOCK

[76] Inventor: Robert M. Blinstrub, 1783 Lexington Dr., Troy, Mich. 48084

[21] Appl. No.: 159,085

[22] Filed: Nov. 29, 1993

[51] Int. Cl.[6] ..... B65D 6/18

[52] U.S. Cl. ..... 220/7

[58] Field of Search ..... 220/6, 7

[56] References Cited

U.S. PATENT DOCUMENTS

| | | | |
|---|---|---|---|
| 4,498,860 | 2/1985 | Gahan | 425/562 |
| 4,591,065 | 5/1986 | Foy et al. | 206/509 |
| 4,674,647 | 6/1987 | Gyenge et al. | 220/6 |
| 4,740,150 | 4/1988 | Sayer | 425/542 |
| 4,775,068 | 10/1988 | Reiland | 220/6 |
| 4,824,732 | 4/1989 | Hendry et al. | 428/542.8 |
| 4,917,255 | 4/1990 | Foy et al. | 206/503 |
| 4,923,079 | 5/1990 | Foy | 220/326 |
| 4,923,666 | 5/1990 | Yamazaki et al. | 264/572 |
| 4,923,667 | 5/1990 | Sayer | 264/572 |
| 5,094,356 | 3/1992 | Miller | 220/326 |

*Primary Examiner*—Joseph Man-Fu Moy
*Attorney, Agent, or Firm*—Bliss McGlynn

[57] ABSTRACT

A collapsible material handling container (10) of the type for packaging, shipping and inventorying goods including a base (12), a pair of sidewalls (14), and a pair of end walls (16). Each of the walls (14, 16) are hingedly connected to the base (12) and moveable between a collapsed position wherein the walls (14, 16) are folded one on top of the other and an upright position wherein the walls (14, 16) extend vertically upward from the base (12) and adjacent walls (14, 16) are interlocked together to define a smooth planer interior surface of the container (10).

5 Claims, 7 Drawing Sheets

COLLAPSIBLE MATERIAL HANDLING CONTAINER HAVING IMPROVED CORNER INTERLOCK

BACKGROUND OF THE INVENTION (1) Technical Field

The invention relates to a material handling container of the type for packaging, shipping, and inventorying goods. More specifically, the invention relates to a reusable, molded thermoplastic container which is collapsible when empty and stackable in either the collapsed or upright position in order to reduce the space required to ship or inventory goods stored in the container.

(2) Description Of The Prior Art

Material handling containers used for packaging, shipping and inventorying goods are well known in the art. For example, U.S. Pat. No. 4,591,065 issued to Foy on Mar. 27, 1986; U.S. Pat. No. 4,917,255 issued to Foy et al. on Apr. 17, 1990; U.S. Pat. No. 4,923,079 issued to Foy; U.S. Pat. No. 4,674,647 issued to Gynge et al. on Jun. 23, 1987; U.S. Pat. No. 4,775,068 issued to Reiland et al. on Oct. 4, 1988; and U.S. Pat. No. 5,094,356 issued to Miller on Mar. 10, 1992 all disclose collapsible containers having a base and four walls which are hingedly connected to the base. The walls are moveable between a collapsed position where the walls are folded one on top of the other and an upright position where the walls extend vertically upward from the base to define an interior of the container.

Each of the containers disclosed in the patents listed above include structure at the juncture between adjacent walls which help hold the walls together when the walls are in their erect and upright position. For example, the Foy et al. '255 patent discloses a series of delta shaped tabs on the sidewalls which are received by corresponding openings or sockets on the end walls when the walls are in their upright, erect position. The tabs are molded so as to create a corresponding series of depressions on the opposite side of the sidewall from the tabs. When the container is in its upright position, these depressions form irregular surfaces on the interior of the container.

Large collapsible containers of this type have potential use shipping liquid in bulk via a liner disposed in the container. However, irregular surfaces on the interior of the container can cause the liner to tear and the liquid to leak. Thus, there is a need for a container having structure at the adjacent sidewalls which can effectively hold the walls together and which maintains a smooth planer surface on the interior of the container when the walls are in their upright position.

The subject invention overcomes all of these deficiencies in the prior art and meets the above-identified needs in a durable, light-weight, container which can be molded using common tools with shorter cycle times and is capable of successfully handling liquid in bulk.

SUMMARY OF THE INVENTION AND ADVANTAGES

The subject invention is directed toward a material handling container of the type for packaging, shipping and inventorying goods including a base, a pair of sidewalls and a pair of end walls and, optionally, a lid. Each of the walls are hingedly connected to the base and moveable between a collapsed position wherein the walls are folded one on top of the other in an upright position wherein the walls are extended vertically upward from the base to define an interior of the container. Such a container may be stacked one on top of the other when the container is in either its upright or collapsed position.

The material handling container of the subject invention further includes a wall interlocking system on adjacent side and end walls for providing interlocking engagement therebetween when the walls are in their upright position. The wall interlocking system includes terminal portions disposed along either edge of the sidewalls and which define a plane substantially parallel with the plane defined by the sidewalls. The terminal portions are themselves defined by a pair of marginal members disposed in spaced parallel relationship with respect to one another and are parallel to the plane defined by the associated sidewall. The terminal portions further include a plurality of reinforced flanges extending therebetween so as to form box like sections between the marginal members while presenting a smooth planer surface on the surface of the sidewall facing the interior of the container at the terminal portions when the container is in its upright position. In this way, the container may be adapted to receive a liner for transporting and storing liquid in bulk without the danger of damage to the liner from contact with rough, irregular surfaces.

The terminal portions further include at least one tab extending from the terminal portions in a direction away from the interior of the container and having arcuately shaped conically converging surfaces defining a truncated cone. The wall locking means also includes corner portions disposed along either edge of the end walls and defining a plane which is parallel to the plane defined by an adjacent sidewall when the adjacent side and end walls are in their upright position. The corner portions include at least one socket having arcuately shaped conically converging surfaces corresponding to the tab on the sidewall and adapted to receive this tab and thereby locking the adjacent side and end walls together when these walls are in their upright position.

BRIEF DESCRIPTION OF THE DRAWINGS

Other advantages of the present invention will be readily appreciated as the same becomes better understood by reference to the following detailed description when considered in connection with the accompanying drawings wherein.

DESCRIPTION OF THE PREFERRED EMBODIMENT

Figure 1:
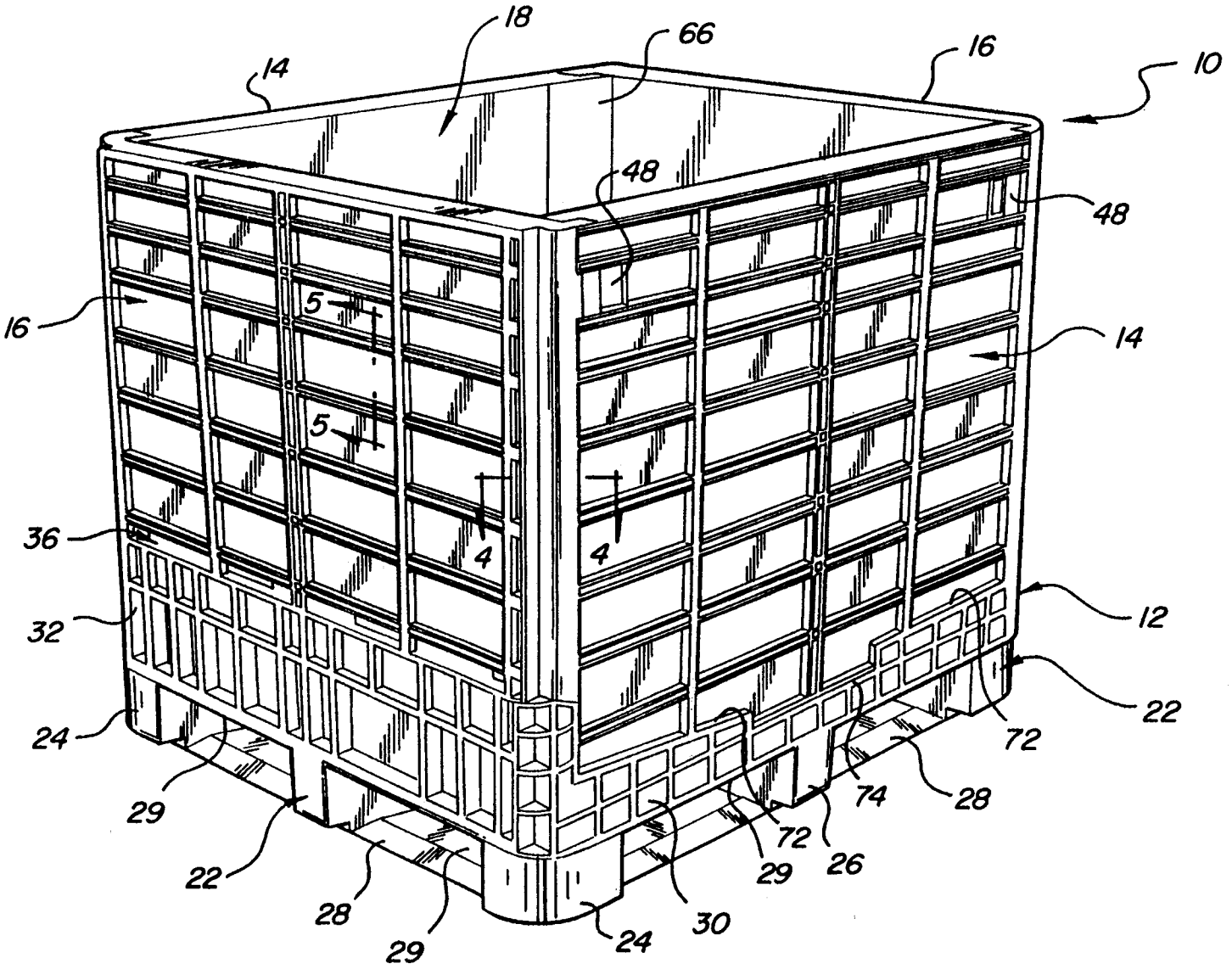
FIG. 1 is a perspective view of the material handling container of the subject invention with the walls in their upright position.
Figure 2:
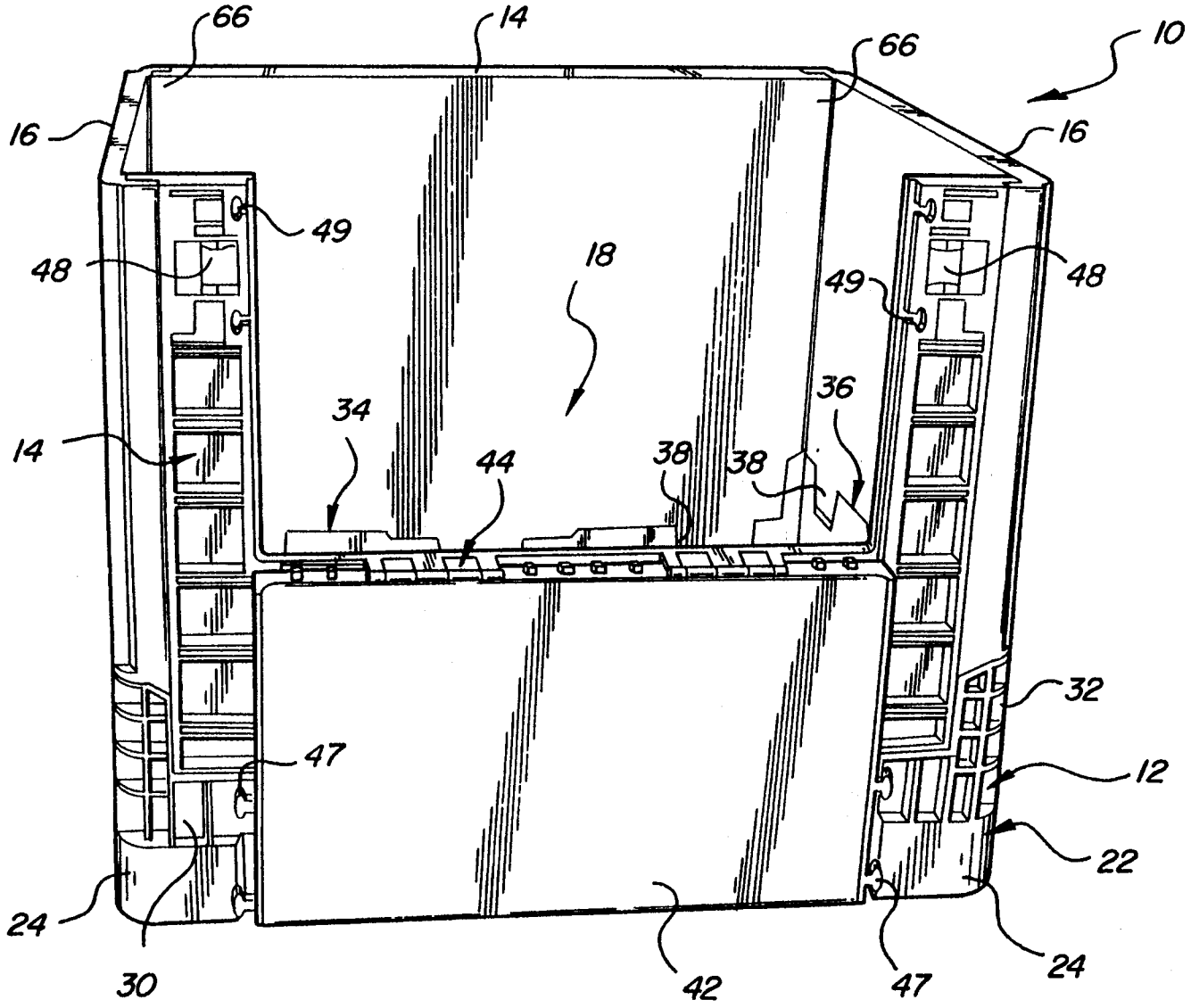
FIG. 2 is a perspective view wherein the drop door in the sidewall is folded outward and showing the smooth planer interior of the container.

The subject invention is directed toward a collapsible material handling container of the type for packaging, shipping and inventorying goods and is generally shown at 10 in FIGS. 1 and 2. The container is molded of a thermoplastic material and includes a base, generally indicated at 12, a pair of sidewalls 14 and a pair of end walls 16. Each of the walls 14, 16 are hingedly connected to the base 12 and moveable between a collapsed position wherein the walls are folded one on top of the other as shown in FIG. 9 and an upright position wherein the walls extend vertically upward from the base 12 to define an interior 18 of the container 10 as shown in FIGS. 1 and 2.

Figure 3:
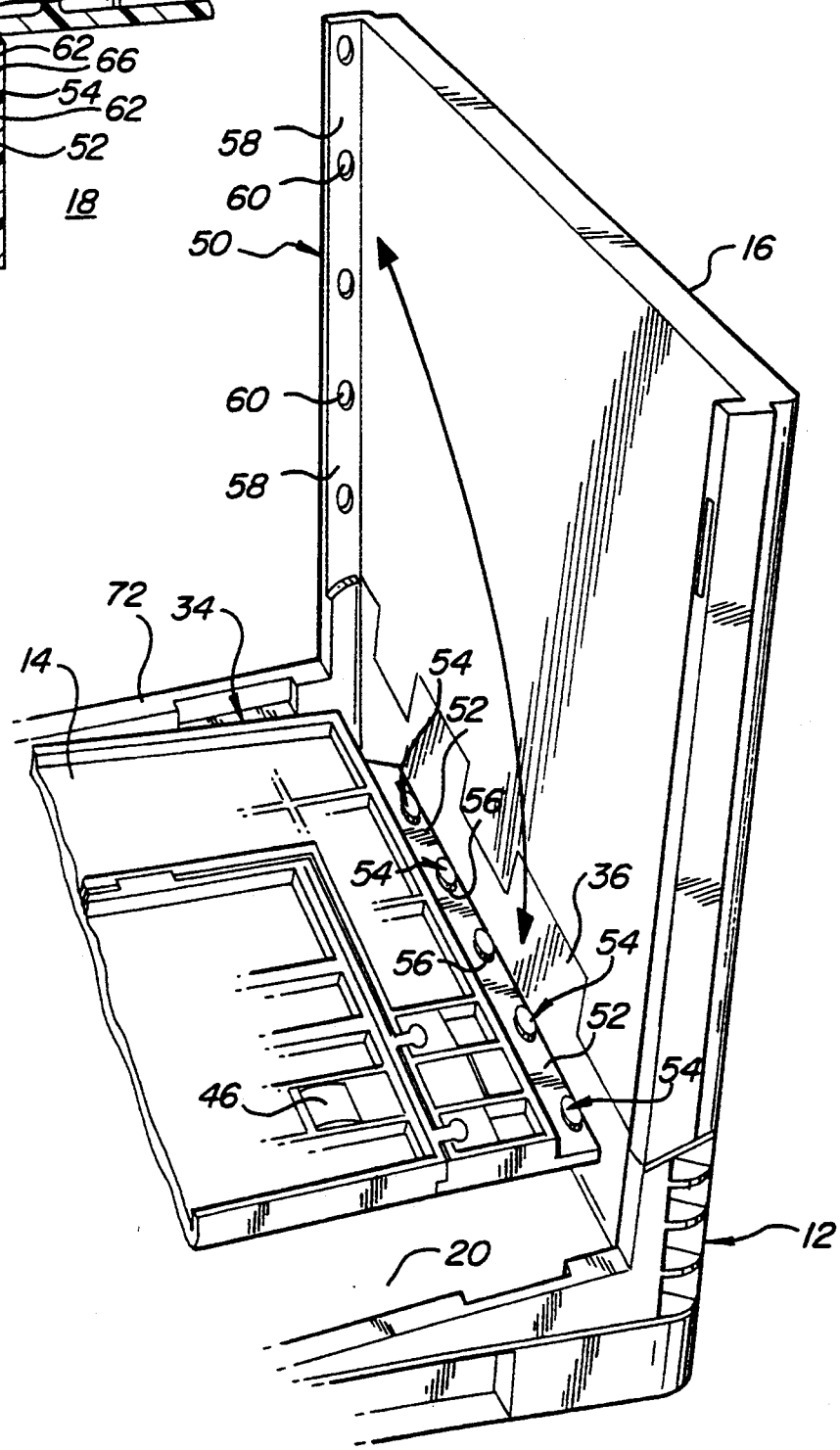
FIG. 3 is a partially broken away perspective view of the container showing an end wall in its upright, erect position and a sidewall disposed between its collapsed and upright position.
Figure 5:
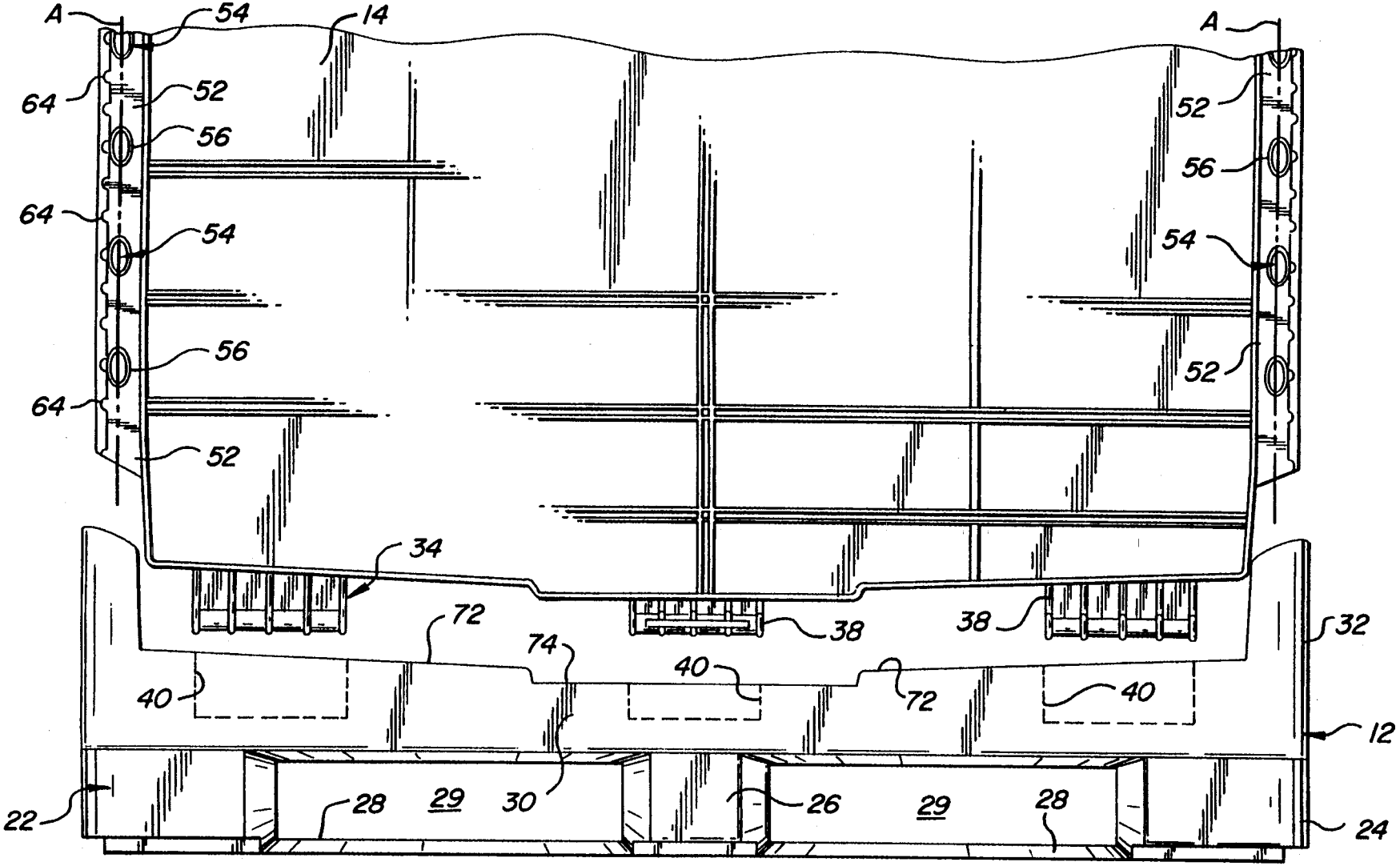
FIG. 5 is an exploded side view of the base and one sidewall of the subject invention.

The base 12 presents a bottom 20 of the container, a portion of which can be seen in FIG. 3, and which can take the form of either a solid planer sheet of plastic or a grid-like configuration wherein the interior 18 of the container 10 is exposed to the environment at the base 12. Alternatively, the bottom 20 can be any combination of solid planer sheets or grid-like configuration.

The base 12 further includes a series of legs, generally indicated at 22, extending from the bottom 20 of the container. The series of legs includes corner legs 24 located at each of the four corners of the container 10 and intermediate legs 26 disposed between the corner legs 24 along the perimeter of the base 12. Straps 28 extend between the legs 22 and define channels 29 between predetermined legs 22. More specifically, the straps 28 extend between corner legs 24 and intermediate legs 26 to define a pair of channels 29 on each side of the container for receiving the forks of a forklift to facilitate the raising and lowering of a container 10.

The base 12 also includes a pair of oppositely disposed short base sides 30 extending upwardly from and integrally with the bottom 20 of the base 12 and corresponding to the sidewalls 14. Similarly, a pair of opposed base sides 32 corresponding to the end walls 16 also extend upwardly from the bottom 20 of the base.

As will be discussed in greater detail below, each of the sidewalls 14 is hingedly connected through a tongue and groove type hinge, generally indicated at 34, to the upstanding sides 30 of the base 12. Similarly, each of the end walls 16 is hingedly connected through a tongue and groove type hinge, generally indicated at 36, to the upstanding sides 32 of the base 12. As can best be seen with respect to a sidewall 14 in FIG. 6, each hinge 34, 36 includes tongues 38 extending from the walls 14, 16 and which are adapted to be received in corresponding grooves or sockets 40 in the base sides 30, 32. Both the tongues 38 and sockets 40 include aligned apertures which receive a rod which forms a hinge axis about which the side and end walls rotate between collapsed and upright positions.

As best shown in FIG. 2, at least one of the sidewalls 14 includes a drop door 42 hingedly connected to the sidewall via a tongue and groove type hinge 44 in the same manner that the walls 14, 16 are hinged to the base 12. The drop door 42 is rotatably moveable between an open position as shown in FIG. 2 and a closed position wherein the door 42 is latched to the sidewall 14 via latches 46 shown in FIG. 3 as is common in the art. The drop door 42 further includes oval shaped tabs 47 disposed along the edges thereof which are received in corresponding sockets 49 in the sidewall 14 at the opening created by the door 42. The drop door 42 provides access to the interior 18 of the container 10 through a sidewall 14 when the container is in its erect, upright position. Similarly, wall latches 48 are employed to latch adjacent side and end walls together when they are in their upright position.

Figure 4:
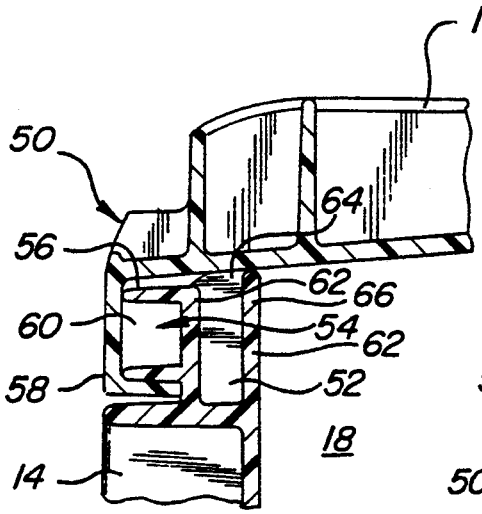
FIG. 4 is a cross-sectional view taken substantially along lines 4—4 of FIG. 1.

In addition to the latches 48 and referring to FIGS. 3 and 4, the container 10 also includes a wall interlocking system, generally indicated at 50, located on adjacent side and end walls 14, 16 for providing interlocking engagement therebetween when the walls are in their upright position. More specifically, the wall locking system 50 includes terminal portions 52 disposed along either edge of the sidewalls 14 defining planes which are substantially parallel to the plane defined by the sidewall 14 associated with the terminal portions 52. The terminal portions 52 include at least one, but preferable a plurality of, tabs, generally indicated at 54, disposed at predetermined spaced intervals along the terminal portions 52 and extending from the terminal portions 52 in a direction away from the interior 18 of the container 10. The tabs 54 have arcuately shaped, conically converging surfaces 56 which define a truncated cone. The arcuate surfaces 56 form an oval shaped tab 54 when viewed in FIG. 6. The oval shaped tabs 54 have a longitudinal axis A which is substantially vertical and perpendicular to the bottom 20 of the base 12 when the walls 14 are in their upright position.

The wall interlocking system 50 includes corner portions 58 which are disposed along either edge of the end walls 16. As best shown in FIGS. 1 and 4, the corner portions 58 form wrap-around edges to the container 10 and thus substantially defines a plane which is parallel to the plane defined by the adjacent sidewalls 14 when the adjacent side and end walls are in their upright position. The corner portions 58 includes at least one, but preferably a plurality of, sockets 60 disposed at predetermined spaced intervals along the corner portion 58 and corresponding to the tabs 54. More specifically, each of the sockets 60 have arcuately shaped, conically converging, oval shaped surfaces corresponding to the tabs 54 which are adapted to receive the tabs in a snug fashion and thereby lock adjacent side and end walls 14, 16 together when the adjacent walls are in their upright position. Further, the arcuately shaped conically converging surfaces of the tabs 54 and the corresponding sockets 60 aid in the interlocking action of the adjacent side and end walls because there are no sharp corners or angle surfaces which require close tolerances in order to precisely interfit. In addition, the arcuate surfaces form continuous interlocks about the entire peripheral surfaces of the tabs 54 and sockets 60 which strengthens the corner of the container 10 when in its upright position.

Figure 6:
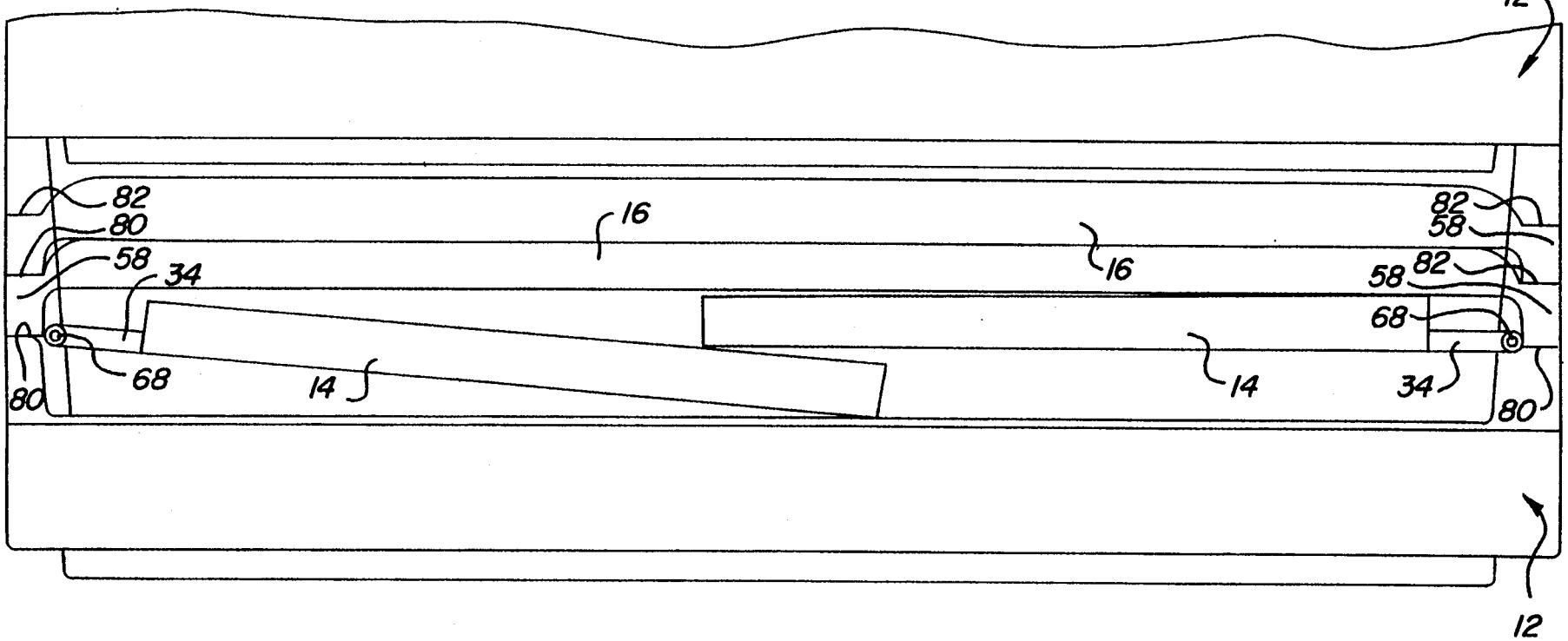
FIG. 6 is a side view of the container when the walls are in their collapsed position with another container stacked thereon.

Referring now to FIGS. 4 and 6, the terminal portions 52 are themselves defined by a pair of marginal members 62 which are disposed in spaced parallel relationship with respect to one another and parallel to the plane defined by their associated sidewalls 14. A plurality of reinforcing flanges 64 extend between the marginal members 62 so as to form open ended box-like sections between the marginal members 62. This arrangement strengthens the terminal portions 52 while presenting a smooth planer surface on the surface 66 of the marginal members 62 facing the interior 18 of the container at the terminal portions 52 when the container is in its upright position. As such, the side and end walls 14, 16 present smooth planer surfaces facing the interior of the container even on the surface 66 of the marginal members 62 of the terminal portions 52 of the sidewalls 14. In this way, the container 10 is adapted to receive a liner (not shown) which may be employed to inventory and ship liquid in bulk without the danger that the liner will tear, rip or otherwise leak due to contact with sharp or irregular, non-smooth surfaces facing the interior of the container.

Figure 7:
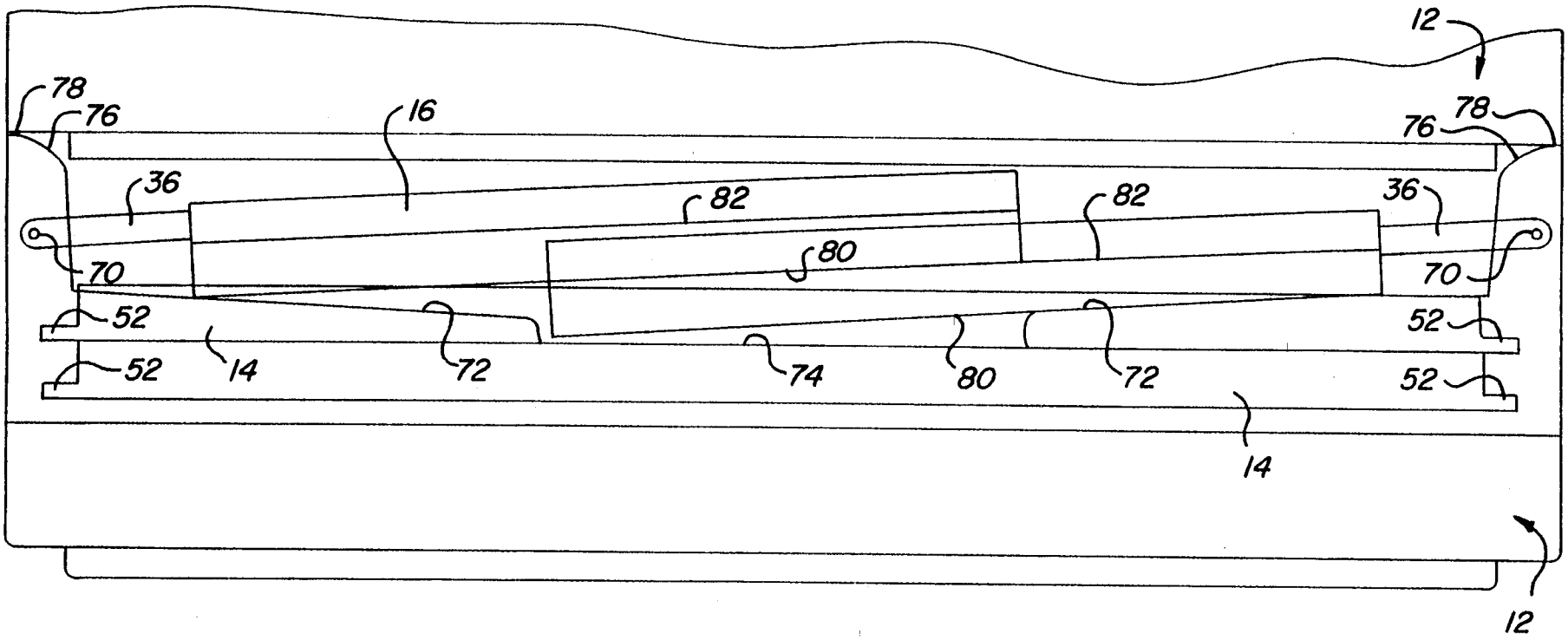
FIG. 7 is another side view of the container when the walls are in their collapsed position with another container stacked thereon.
Figure 8:
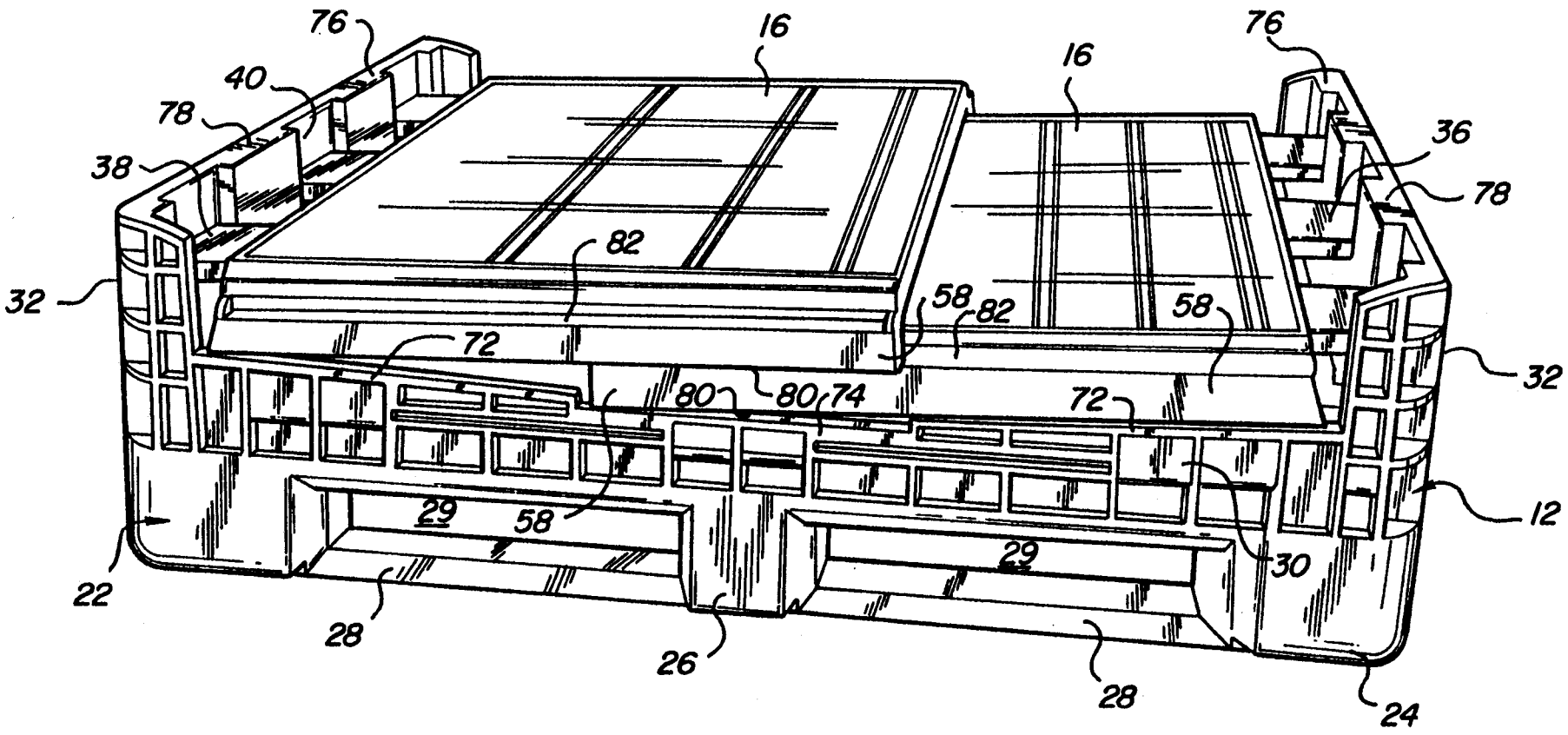
FIG. 8 is a perspective view of the container when the walls are in their collapsed position.

Referring now to FIGS. 7–9, the hinges 34 for opposed sidewalls 14 define a pair of axes 68 about which the sidewalls are rotatable between their collapsed and upright positions. Similarly, the hinges 36 for the opposed end walls 16 define a pair of axes 70 about which the end walls are rotatable between their collapsed and upright positions. Referring specifically to FIG. 7, it can be seen that the hinge axes 68 for the opposed sidewalls 14 are disposed on a common horizontal plane bisecting these axes 68. When the container 10 is in the collapsed position, the sidewalls 14 are rotated to this position first. Because sidewall hinge axes 68 are on the same plane, the planes defined by the opposed sidewalls 14 intersect when in this position. However, the sidewalls 14 are isolated from any loadbearing responsibility and therefore this arrangement does not degrade the structural integrity of the container.

Similarly, and referring specifically to FIG. 8, it can be seen that the hinge axes 70 for the opposed end walls 16 are also disposed on a common horizontal plane bisecting these axes 70. However, the plane bisecting the hinge axes 68 is spaced vertically from and parallel to the plane bisecting the hinge axes 70. Further, unlike the sidewalls 14, the end walls 16 are supported as will be discussed in further detail below.

The base sides 30 for the opposed sidewalls 14 form a pair of ramping surfaces 72 which define oppositely opening arcuate angles with the sidewall hinge axes 68. The base sides 30 also include horizontal surfaces 74 disposed between the two ramping surfaces 72 and parallel to the hinge axes 68.

The base sides 32 for the opposed end walls 16 have an upper marginal edge 76 disposed above each hinge axis 68, 70 which forms a platform surface 78 for supporting another container 10 when one container is stacked on another in the collapsed position.

The end wall corner portion 58 includes stacking surfaces 80 forming the terminal edge thereof and which are adapted to rest upon and be supported by the ramping surfaces 72 and a portion of the horizontal surface 74 at an angle to the horizontal when the container 10 is collapsed. However, only the stacking surfaces 80 of the first end wall 16 which is collapsed is supported as described above. The second collapsed end wall 16 is supported as follows.

The end walls 16 include wall support surfaces 82 disposed in parallel spaced relationship to the stacking surfaces 80 on the opposite sides of the corner portions 58 from the stacking surfaces 80. A portion of the wall support surfaces 82 on the first collapsed end wall are employed to support the other, second collapsed end wall 16 along the second end walls stacking surface 80 when both end walls are in their collapsed position.

In this way, it does not matter which sidewall is moved to its collapsed position first. This step is therefore nonsequential. Similarly, the sequence of collapse of the end walls is irrelevant.

The collapsible material handling container as described above is preferably molded of a thermoplastic such as high density polyethylene, or Xenoy ®, Cycolac ®, Cycoly ® or Lexan ®, the latter four of which are engineering thermoplastics available from General Electrict Company GE Plastics division. Unlike the material handling containers of the prior art, the container of the subject invention is not formed using a structural foam molding process. Rather, the walls and base of the subject invention are formed via a gas assist, low pressure injection molding process using the methods and apparatuses as described for example in U.S. Pat. No. 4,824,732 issued to Watson et al. for a Process and Apparatus for Injection Moulding and Mouldings Produced Thereby; U.S. Pat. No. 4,740,150 issued to Sayer for an In-mold Gas Injection Nozzle; U.S. Pat. No. 4,498,860 issued to Gahan for a Sprue Cut Off; U.S. Pat. No. 4,923,666 issued to Yamazaki et al. for a Plastic Filled Mold; and U.S. Pat. No. 4,923,667 issued to Sayer for a Gas Vent Pin.

The resulting cross-sectional thickness of any wall or portion of the base can be as little as 0.150 inches. This reduces the weight of the container as compared with the structural foam molding containers of the prior art, which in turn reduces the time needed to cool the part in the mold and therefore reduces the cycle time and labor needed to mold any given part of the container.

The invention has been described in an illustrative manner, and it is to be understood that the terminology which has been used is intended to be in the nature of words of description rather than of limitation.

Obviously, many modifications and variations of the present invention in light of the above teachings may be made. It is, therefore, to be understood that within the scope of the appended claims wherein reference numerals are merely for convenience and are not to be in any way limiting, the invention may be practiced otherwise than as specifically described.

What is claimed is:

1. A collapsible container (10) comprising;

a base (12), a pair of sidewalls (14), a pair of end walls (16), each of said walls (14) hingedly connected to said base (12) and moveable between a collapsed position wherein said walls (14, 16) are folded one on top of the other and an upright position wherein said walls (14, 16) extend vertically upward from said base (12) to define an interior (18) of said container (10);

a wall interlocking system (50) on adjacent side (14) and end (16) walls for providing interlocking engagement therebetween when said walls are in said upright position, said wall interlocking system (50) including terminal portions (52) disposed along either edge of said sidewalls (14) and defining a plane substantially parallel with the plane defined by said sidewalls (14), said terminal portions (52) including at least one tab (54) extending from said terminal portions (52) in a direction away from said interior (18) of said container (10) and having arcuately shaped conically converging surfaces (56) defining a truncated cone;

said wall interlocking system (50) including corner portions (58) disposed along either edge of said end wall (16) and defining a plane which is parallel to the plane defined by an adjacent sidewall (14) when said adjacent side and end walls (14, 16) are in their upright position, said corner portions (58) including at least one socket (60) having arcuately shaped conically converging surfaces corresponding to said at least one tab (54) and adapted to receive said tab (54) and thereby locking said adjacent side and end walls (14, 16) together when said adjacent walls (14, 16) are in their upright position.

2. A container (10) as set forth in claim 1 further characterized by including a plurality of tabs (54) disposed at predetermined spaced intervals along said terminal portions (52) of said sidewalls (14) and a plurality of sockets (60) disposed at predetermined spaced intervals on said corner portions 58 and corresponding to said tabs (54), each of said tabs (54) adapted to be received by said sockets (60) in a snug fashion thereby locking said walls (14, 16) together when said adjacent walls (14, 16) are in their upright position.

3. A container (10) as set forth in claim 2 further characterized by said arcuately shaped surfaces (56) of said tabs (54) substantially defining oval shaped tabs (54), said arcuately shaped surfaces of said sockets (60) corresponding to said oval shaped tabs (54).

4. A container (10) as set forth in claim 3 further characterized by said oval shaped tabs (54) defining a longitudinal axis A which is substantially perpendicular to said base (12) when said walls (14, 16) are in their upright position.

5. A collapsible container (10) comprising;

a base (12), a pair of sidewalls (14), a pair of end walls (16), each of said walls (14, 16) hingedly connected to said base (12) and moveable between a collapsed position wherein said walls (14, 16) are folded one on top of the other and an upright position wherein said walls (14, 16) extend vertically upward from said base (12) to define a smooth planer interior (18) of said container (10);

said sidewalls (14) including terminal portions (52) disposed along either edge of said sidewalls (14) and defining a plane substantially parallel with the plane defined by said associated sidewalls (14), said terminal portions (52) defined by a pair of marginal members (62) disposed in spaced parallel relationship with respect to one another and parallel to said plane defined by said associated sidewall (14) and a plurality of reinforced flanges (64) extending therebetween so as to form box-like sections between said marginal members (62) while presenting a smooth planer surface on the surface of the marginal members (62) facing the interior (18) of the container (10) at the terminal portion when the container (10) is in its upright position.

* * * * *